US008330755B2

(12) United States Patent
Kasai et al.

(10) Patent No.: US 8,330,755 B2
(45) **Date of Patent: *Dec. 11, 2012**

(54) IMAGE DISPLAY DEVICE AND DRIVING METHOD FOR SAME FOR COLLECTIVE WRITE IN

(75) Inventors: Naruhiko Kasai, Yokohama (JP); Masato Ishii, Tokyo (JP); Tohru Kohno, Kokubunji (JP); Hajime Akimoto, Kokubunji (JP)

(73) Assignees: Hitachi Displays Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 903 days.

This patent is subject to a terminal disclaimer.

(21) Appl. No.: 12/292,801

(22) Filed: Nov. 26, 2008

(65) Prior Publication Data

US 2009/0141017 A1 Jun. 4, 2009

(51) Int. Cl.
*G09G 3/20* (2006.01)
*G06G 5/00* (2006.01)

(52) U.S. Cl. ..... 345/214; 345/55; 345/204; 345/208; 345/212

(58) Field of Classification Search ..... 345/214
See application file for complete search history.

(56) References Cited

U.S. PATENT DOCUMENTS

2002/0036626 A1* 3/2002 Tsutsui ..... 345/204
2002/0196213 A1* 12/2002 Akimoto et al. ..... 345/82
2003/0058229 A1* 3/2003 Kawabe et al. ..... 345/204
2004/0140968 A1 7/2004 Kasai et al.
2005/0200591 A1* 9/2005 Satoh et al. ..... 345/103
2005/0212783 A1* 9/2005 Kasai et al. ..... 345/204
2009/0141015 A1* 6/2009 Kasai et al. ..... 345/212
2010/0110113 A1 5/2010 Kimura

FOREIGN PATENT DOCUMENTS

JP 2003-005709 6/2001
JP 2004-157250 A 6/2004
JP 2004-341263 A 12/2004
JP 2006-011058 1/2006
JP 2006-227603 A 8/2006

* cited by examiner

*Primary Examiner* — Alexander Eisen
*Assistant Examiner* — Karin Kiyabu
(74) *Attorney, Agent, or Firm* — Stites & Harbison, PLLC; Juan Carlos A. Marquez, Esq

(57) ABSTRACT

An image display with high brightness where a long time can be secured for light emission of self-luminous elements can be implemented using only line memories.

The period for the writing in of a display voltage (period for writing in of data) continues for a number of lines (three lines), and the reset pulse becomes of a "high" state. Subsequently, operation for three lines is carried out collectively during a triangular wave period (period for writing in of a triangular wave voltage), and only the light emission controlling pulse becomes of a "high" state. During the period for the writing in of a triangular wave voltage, the writing in of a triangular wave voltage from the second time onward is rewriting of a triangular wave voltage, and thus, the period for rewriting the display voltage (dotted line portion) becomes unnecessary, and a longer period for light emission, where the light emission controlling pulse becomes of a "high" state, can be secured.

3 Claims, 10 Drawing Sheets

IMAGE DISPLAY DEVICE AND DRIVING METHOD FOR SAME FOR COLLECTIVE WRITE IN

BACKGROUND OF THE INVENTION

The present invention relates to an image display device in which an EL (electroluminescence) element, an organic EL element or another self-luminous element which is a self-luminous type display element is mounted, as well as a driving method for the same.

Self-luminous elements, such as EL (electroluminescence) elements and organic EL elements, have such properties that the brightness is proportional to the current which flows through the self-luminous element, and thus, display with gradation is possible by controlling the current which flows through the self-luminous element. A display device can be fabricated by providing a number of such self-luminous elements.

Meanwhile, drive transistors for controlling the current which flows through the self-luminous element are inconsistent in terms of their properties, as a result of the manufacturing process, and this inconsistency in terms of the properties causes inconsistency in the drive current, and ultimately leads to inconsistency in the brightness, and thus is a factor in lowering the image quality.

As a circuit for solving this problem, Patent Document 1 (Japanese Unexamined Patent Publication 2003-5709) discloses a technology for display with gradation by writing a display data signal using the properties of the drive transistors as a reference during each horizontal period (one-line period), and after that inputting a triangular wave for controlling the timing for illumination, and thus controlling the time for luminescence while cancelling inconsistency in the properties of the drive transistors.

SUMMARY OF THE INVENTION

The invention disclosed in Patent Document 1 relates to a driving method which is referred to as a time modulation system for controlling the time for light emission through comparison of the level of the data voltage (signal voltage) and the triangular wave voltage according to which the period for writing in a signal (period for writing in a signal voltage, period for writing in data) and the period for inputting a triangular wave (period for inputting a triangular wave voltage, period for light emission, and period for turning on light) are divided, and the period for lighting in a signal and the period for light emission are divided within, for example, one frame or within each horizontal period.

In order to secure a long time period for light emission within one frame period in this drive, it is necessary to secure a long time period for a retrace line by providing a frame memory so that the period for display is shortened, and therefore the scale of the peripheral circuit becomes great. In addition, in order to secure a long time period for light emission within each horizontal period, it is necessary to provide a line buffer. However, the entirety of the period for a horizontal retrace line cannot practically be a period for light emission. As described below in reference to FIG. 4, light cannot be emitted while a signal voltage is being rewritten to a pixel driving voltage (triangular wave), and therefore a long time period for light emission cannot be secured.

An object of the present invention is to provide an image display device with a highly bright display where a long time period for light emission of self-luminous elements can be secured using only a line memory, as well as a driving method for the same.

When a signal voltage and a triangular wave voltage are rewritten for each period for a horizontal retrace line, the amount of wasteful time during which light cannot be emitted increases, and therefore the present invention provides a configuration where each write-in operation is collectively carried out for a number of lines so that the amount of wasteful time can be reduced. The present invention is gained by adding a line memory corresponding to the above described number of lines for a collective operation and a high speed readout circuit in order to shorten the signal voltage period as much as possible to the conventional configuration. In addition, a circuit is provided where the time for writing in is variable depending on the conditions at the time of write in for each line when the writing in of a signal voltage is continued for a number of lines, for example, depending on in which line from among the number of lines for a collective operation the time for writing a signal voltage in is controlled in response to the difference in the time for writing in which continues after the writing in of a triangular wave.

The time for light emission can be secured for each line, and no frame memory is required so that the configuration of the peripheral circuit is simplified and the time for write in for each line becomes controllable, and thus the difference in the conditions for collective write in of lines can be corrected and an image display with high brightness can be gained.

BRIEF DESCRIPTION OF THE DRAWINGS

These and other features, objects and advantages of the present invention will become more apparent from the following description when taken in conjunction with the accompanying drawings wherein.

DESCRIPTION OF THE EMBODIMENTS

In the following, the preferred embodiments of the present invention are described in detail in reference to the drawings.

Figure 1:
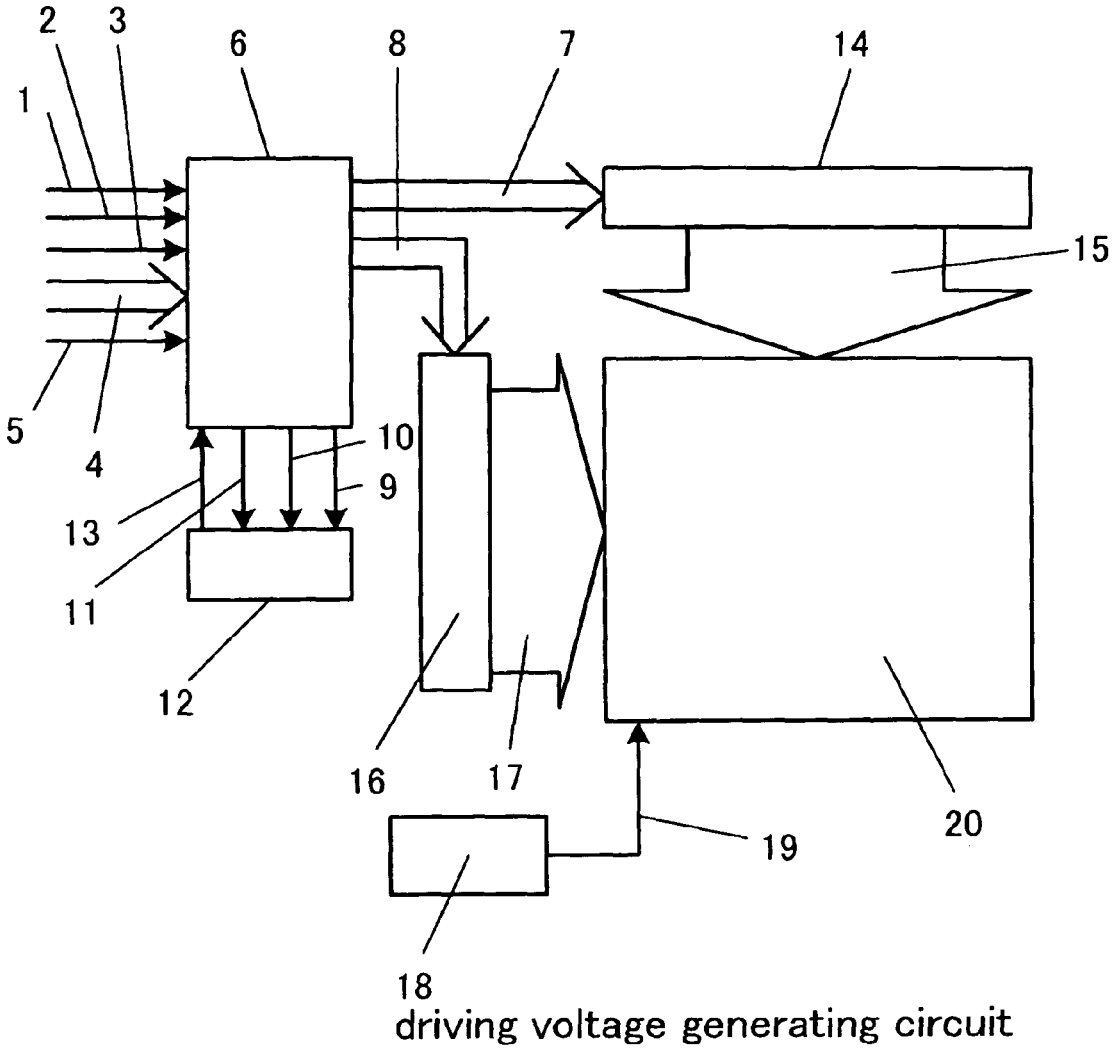
FIG. 1 is a diagram showing the configuration of the image display device using self-luminous elements according to one embodiment of the present invention.

In the following, one embodiment of the present invention is described in detail in reference to the drawings. FIG. 1 is a diagram showing the configuration of an image display device using self-luminous elements according to one embodiment of the present invention. In FIG. 1, the symbol 1 is a vertical sync signal, 2 is a horizontal sync signal, 3 is a data enabling signal, 4 is display data, and 5 is a sync clock. The vertical sync signal 1 is a signal for a period for one screen on the display (one frame period), the horizontal sync signal 2 is a signal for one horizontal period, and the data enabling signal 3 is a signal indicating the period during which the display data 4 is effective (display effective period), and all the signals are inputted synchronizing with sync clock 5.

In the present embodiment, these pieces of display data for one screen are transferred in a raster scanning system starting from the upper left, and the information for one pixel consists of six bit digital data in the following description. The symbol 6 is a display controlling portion, 7 is a data line controlling signal, 8 is a scanning line controlling signal, 9 is a storage circuit controlling signal, 10 is a storage signal controlling address, 11 is storage data, 12 is a horizontal image storing circuit, and 13 is readout data. The display controlling portion 6 generates a storage circuit controlling signal 9 for temporarily storing display data 4 for at least one horizon (one line) of the self-luminous element display (described below) in a horizontal display storing circuit 12 as a write-in controlling signal and generates a storage circuit controlling address 10 as a write-in address and outputs these together with storage data 11.

In addition, the storage circuit controlling signal 9 is generated as a readout controlling signal and the storage circuit controlling address is generated as a readout address in order to readout the storage data 11 as readout data 13 in accordance with the display timing of the self-luminous element display, and they are outputted as a data line controlling signal 7 and a scanning line controlling signal 8 together with the readout data 13. In the present embodiment, the horizontal image storing circuit 12 stores and reads out display data for one line in the following description.

The symbol 14 is a data line driving circuit, 15 is a data line driving signal, 16 is a scanning line driving circuit, 17 is a scanning line driving signal, 18 is a luminous voltage generating circuit, 19 is a self-luminous element luminous voltage, and 20 is a self-luminous element display. The self-luminous element display 20 shows a display using light emitting diodes or organic EL's as display elements and has a number of self-luminous elements (pixels) arranged in a matrix. In the display operation of the self-luminous element display 20, the time for light emission is controlled by applying a signal voltage and a triangular wave signal to pixels on the line selected by the scanning line driving signal 17 outputted from the scanning line driving circuit 16 in accordance with a data line driving signal 15 outputted from the data line driving circuit 14.

Self-luminous elements emit light when a self-luminous element luminous voltage 19 is applied in accordance with the controlled time. Here, the data line driving circuit 14 and the scanning line driving circuit 16 may be implemented in separate LSI's or may be implemented in one LSI. In addition, they may be formed on the same glass substrate as the pixel portion. In the present embodiment, the self-luminous element display 20 has a resolution of 240×320 dots in the following description.

Figure 2:
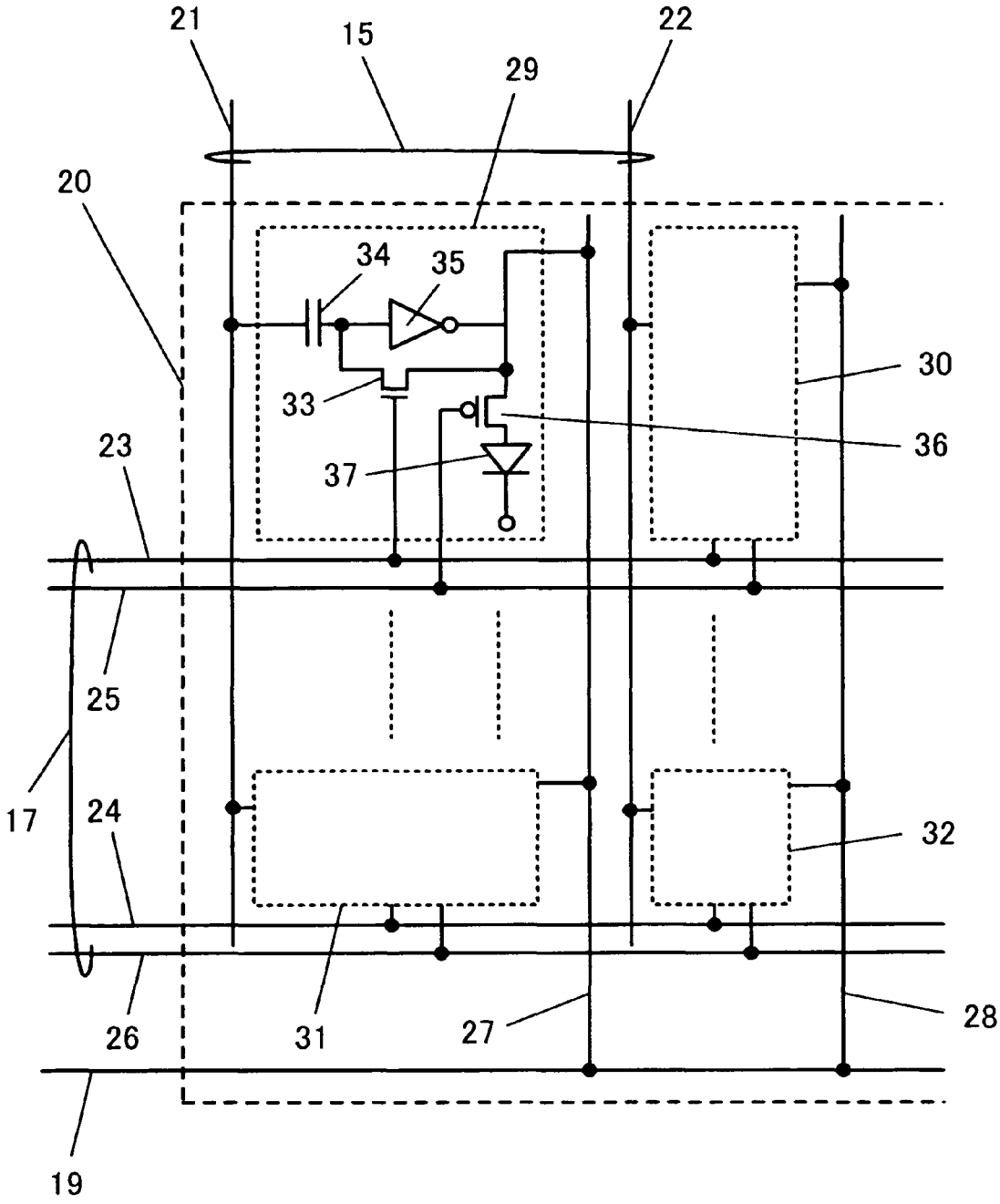
FIG. 2 is a circuit diagram illustrating an example of the internal configuration of the self-luminous element display in FIG. 1.

FIG. 2 is a circuit diagram illustrating an example of the internal configuration of the self-luminous element display 20 in FIG. 1 and shows an example of a case where organic EL elements are used as self-luminous elements. In FIG. 2, the symbol 21 is a first data line, 22 is a second data line, 23 is a first scanning line, 24 is a $320^{th}$ scanning line, 25 is a first light emission controlling line, 26 is a $320^{th}$ light emission controlling line, 27 is a first column luminous voltage supplying line, 28 is a second column luminous voltage supplying line, 29 is a pixel in first row and first column, 30 is a pixel in first row and second column, 31 is a pixel in $320^{th}$ row and first column, and 32 is a pixel in $320^{th}$ row and second column. A signal voltage and a triangular wave are supplied to pixels in a row selected by the respective scanning lines via the respective data lines so that the time for light emission is controlled in accordance with the relationship between the signal voltage and the triangular wave.

Here, though only the pixel 29 in first row and first column in the configuration inside the pixels is shown, all other pixels including the pixel 30 in first row and second column (all pixels including those which are not shown) have the same configuration. The symbol 33 is a reset switch, 34 is a write-in capacitor, 35 is a drive inverter, 36 is a light emission controlling switch, and 37 is an organic EL. The reset switch 33 becomes of an "on" state by means of the first scanning line 23, and at this time the input and the output of the drive inverter 35 are connected, and therefore a reference voltage in accordance with the properties of the transistors which form the drive inverter 35 for the respective pixels is set, and a signal voltage from the first data line 21 is stored in the write-in capacitor 34 using this as a reference.

The output of the drive inverter 35 becomes of a "low" state when the triangular wave inputted after the writing in of a signal voltage is higher than the signal voltage stored in the write-in capacitor 34 and becomes of a "high" state when it is lower than the signal voltage. When the light emission controlling switch 36 is converted to an "on" state for all the pixels when a triangular wave is inputted, the organic EL 37 emits light. In addition, as described above, the number of pixels in the self-luminous display 20 is 240×320, and therefore 320 scanning lines in the horizontal direction are aligned in the vertical direction from the first scanning line 23 to the $320^{th}$ scanning line 24 and 720 data lines in the vertical direction are aligned in the horizontal direction from the first data line 21, the second data line 22 to the $720^{th}$ data line (not shown) (one pixel is formed of three dots: R, G and B) in the following description.

Furthermore, the self-luminous element voltage 19 is supplied from beneath the self-luminous element display 20, and 720 luminous voltage supplying lines in vertical direction (column direction) starting from the first column luminous voltage supplying line 27, the second column luminous voltage supplying line 28 to the $720^{th}$ column luminous voltage supplying line are connected in the horizontal direction in the following description.

Figure 3:
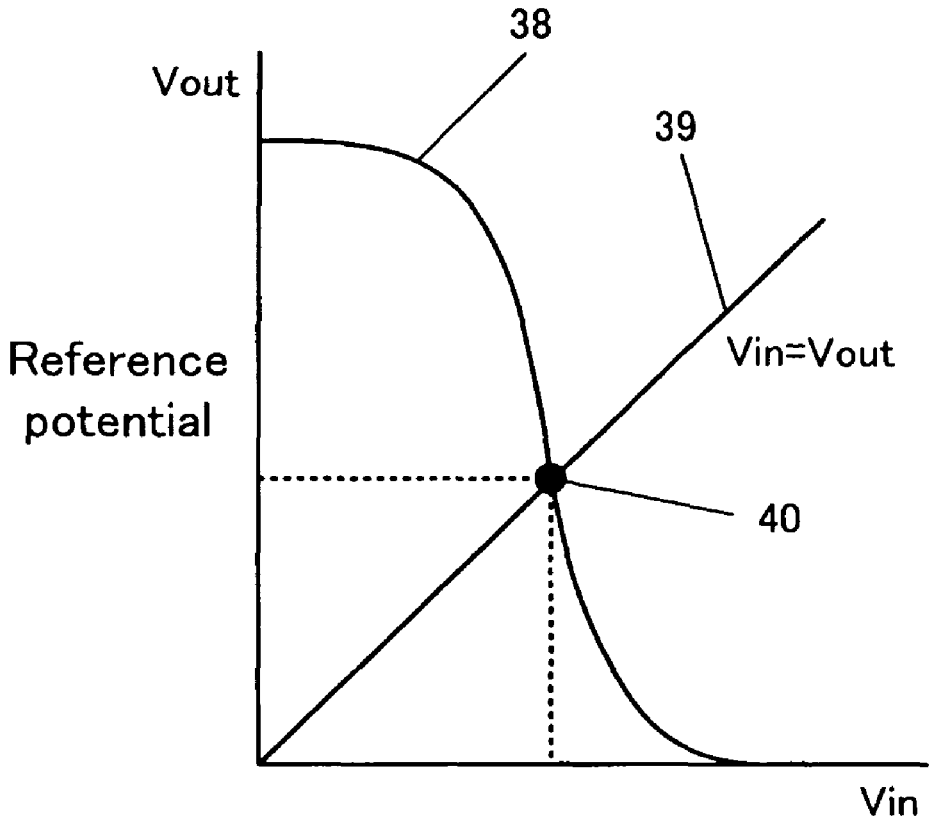
FIG. 3 is a diagram illustrating the setting of a reference voltage for a signal voltage in the drive inverter in FIG. 2.

FIG. 3 is a diagram illustrating the setting of a reference voltage for the signal voltage in the drive inverter 35 in FIG. 2. In FIG. 3, the symbol 38 is input/output properties of the drive inverter 35, 39 is the condition for connecting the input/output, and 40 is a reference potential for the writing in of the signal voltage of the drive inverter 35, and the input and the output of the drive inverter 35 are connected at the time of the write in of data, and therefore the potential of the input and the output becomes the reference potential 40 for the write in of the signal voltage, which is an intersection of the properties for the input/output 38 and the conditions for connecting the input/output 39 indicated by the straight line of Vin=Vout. The writing in of a signal voltage is carried out with this reference voltage 40 for the writing in of a signal voltage 40 as a reference.

Figure 4:
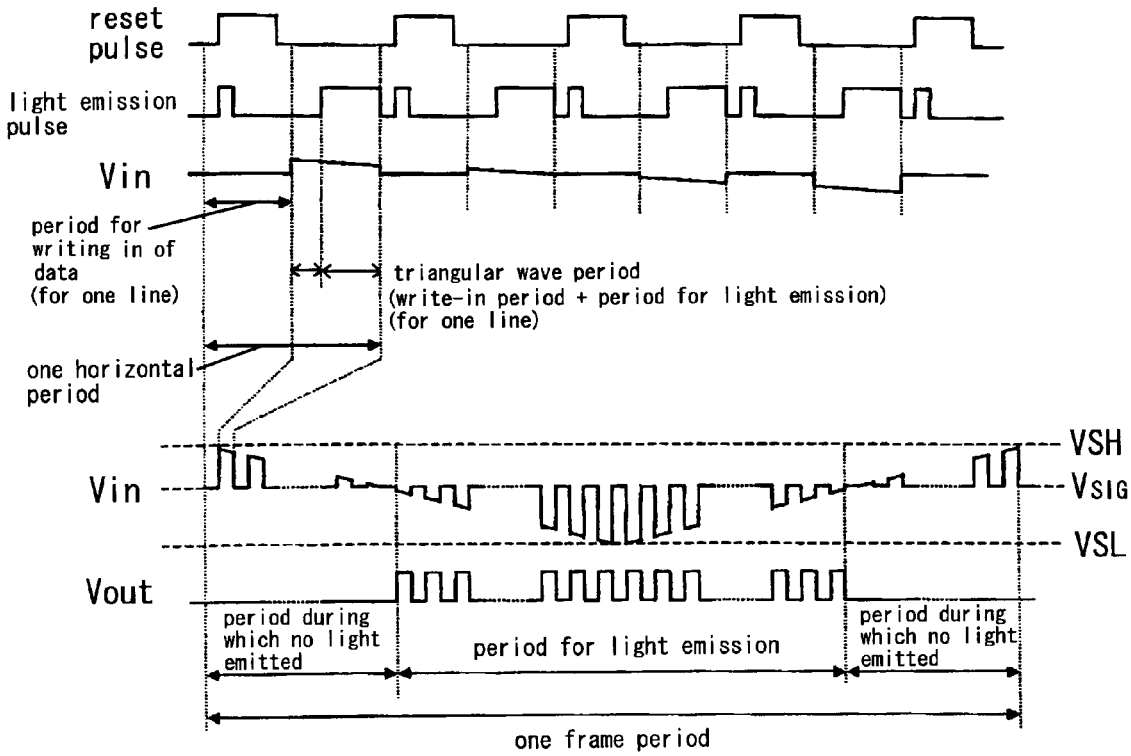
FIG. 4 is a diagram showing waveforms for the writing in of a signal voltage and the operation of controlling the time for the turning on of light using a triangular wave.

FIG. 4 is a diagram showing the timing for the operation of a conventional control for the time of turning on of light where the writing in of data and the input of a triangular wave are repeated for each horizontal period. FIG. 4 is described in reference to the circuit in FIG. 2. In FIG. 4, one horizontal period is divided into a data write-in period and a triangular wave write-in period so that the reset pulse is set to a "high" state and the reset switch is set to an "on" state during the period for the writing in of data, and thus the light emission controlling pulse is set to a "high" state and the light emission controlling switch 36 is set to an "on" state. During the period for the writing in of a triangular wave, a write-in period, which becomes the time for rewriting the signal to a triangular wave voltage, is provided, and after that only the light emission controlling pulse becomes of a "high" state.

A signal voltage (Vsig) is inputted into the drive inverter during the period for the writing in of a data voltage, and the reset pulse and the light emission controlling pulse become of a "high" state so that an odd column driving inverter threshold value voltage is gained with the properties of the drive inverter 35 and the organic EL 37 as a reference. During the period for the writing in of a triangular wave voltage, the voltage of the triangular wave to be written in drops from the high voltage of the triangular wave to the low voltage of the triangular wave over a number of lines, and then rises again to the high voltage of the triangular wave.

In the present embodiment, the triangular wave changes from the triangular wave high voltage to the triangular wave low voltage and then back to the triangular wave high voltage during one frame period. One frame period is one period of a frequency of 60 Hz (approximately 16.7 ms) in the following description. Here, during the period for the writing of a triangular wave, the output of the drive inverter becomes "1" (period for light emission) during the period when the level of the triangular wave is lower than the threshold voltage of the drive inverter and becomes "0" (period during which no light emitted) during the period when the level exceeds the threshold voltage. At this time, the light emission controlling panel becomes of a "high" state during the period for the writing in of a triangular wave so that the light emission controlling switch 36 becomes of an "on" state, and therefore the organic EL 37 emits light during the period of the writing in of a triangular wave during the period for light emission.

Figure 5:
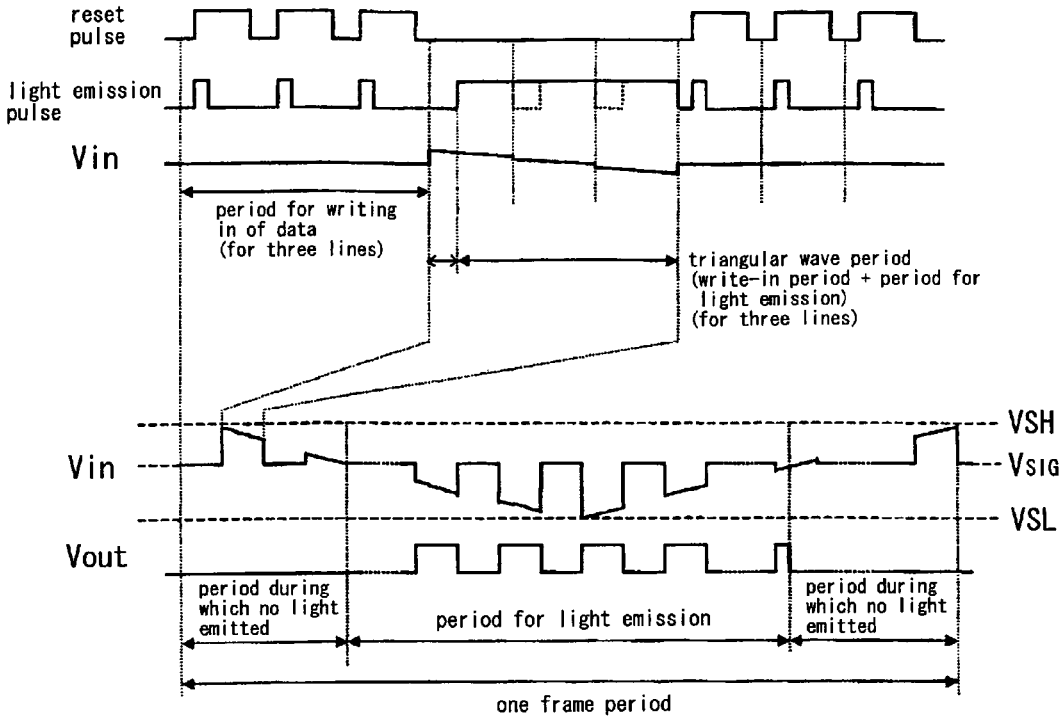
FIG. 5 is a diagram showing waveforms illustrating the operation of controlling the time for the turning on of light according to an embodiment of the present invention where the writing in of a signal voltage for a number of lines collectively and the writing in of a triangular wave voltage are repeated.

FIG. 5 is a diagram showing waveforms for the operation of control of the time for turning on light according to the embodiment of the present invention, where the writing in of a signal voltage for a number of lines for collective operation and the writing in of a triangular wave voltage are repeated. Here, a case where write-in is carried out collectively for three lines is described. The period for the writing in of a display voltage (data write-in period) continues for three lines (three lines in sequence, line by line), during which the reset pulse is set to a "high" state and the reset switch 33 is set to an "on" state. Subsequently, the triangular wave period (period for writing in of triangular wave voltage) continues for three lines in a collective operation, during which only the light emission controlling pulse is of a "high" state. At this time, the operation of the drive inverter 35 is the same as in FIG. 4, and therefore, the description thereof is omitted. Here, during the write-in period for a triangular wave voltage, the rewrite period for the display voltage (dotted line portion in FIG. 5) becomes unnecessary from the second write-in of a triangular wave voltage, and a longer light emission period, during which the light emission controlling pulse becomes of a "high" state can be secured in comparison with the case of FIG. 4.

Figure 6:
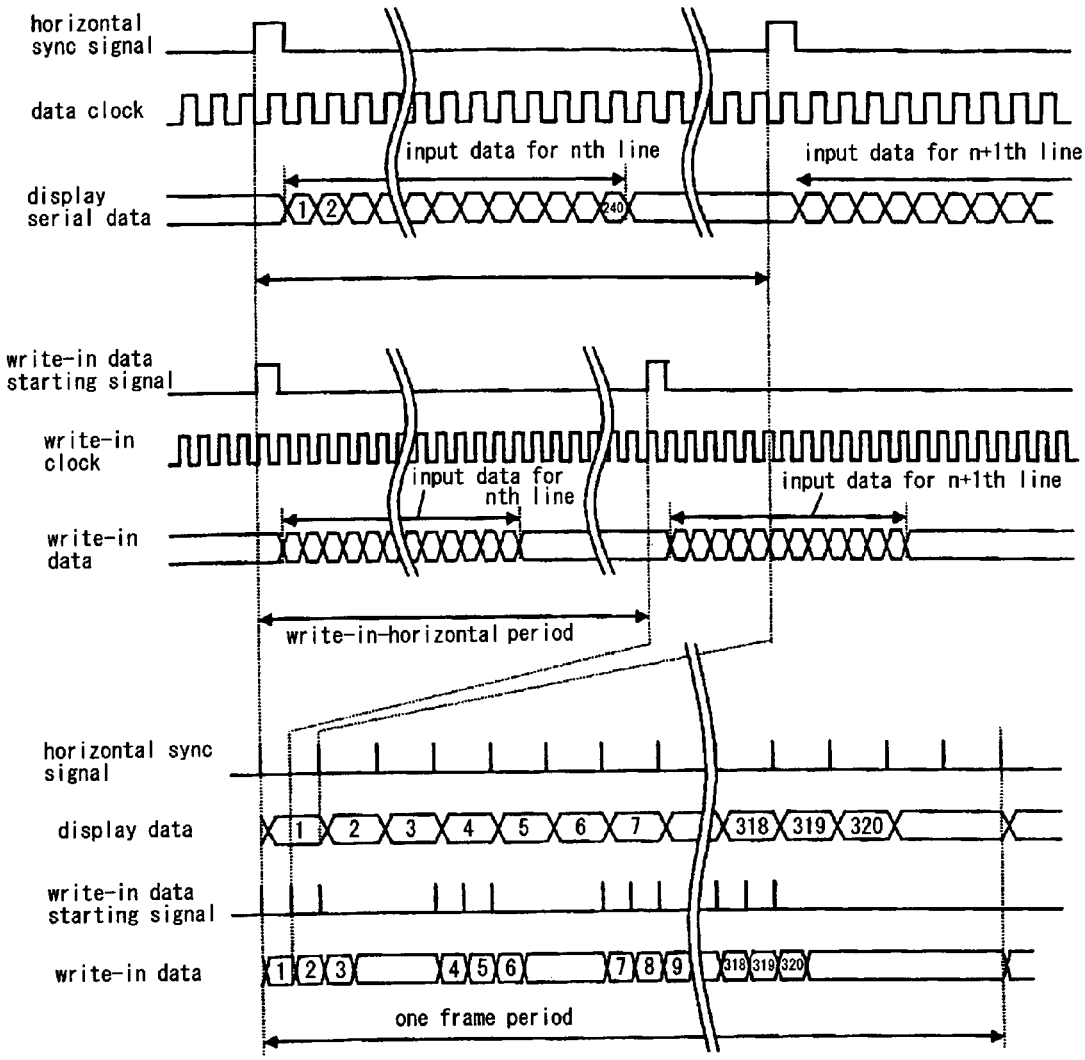
FIG. 6 is a diagram showing waveforms for the operation for securing the period for the horizontal retrace line, that is to say, the period for light emission, in the horizontal image storing circuit shown in FIG. 1.

FIG. 6 is a diagram showing waveforms for the operation of securing the horizontal retrace line period, that is to say, the light emission period, in the horizontal image storing circuit shown in FIG. 1. In FIG. 6, the speed of the write-in data starting signal and the write-in clock signal is higher relative to the horizontal sync signal and the data clock signal to be inputted. In the present embodiment, write-in data for three lines is read out during the period for input of 1.5 lines, and the remaining 1.5 lines are used for the horizontal retrace period, that is to say, the light emission period.

Figure 7:
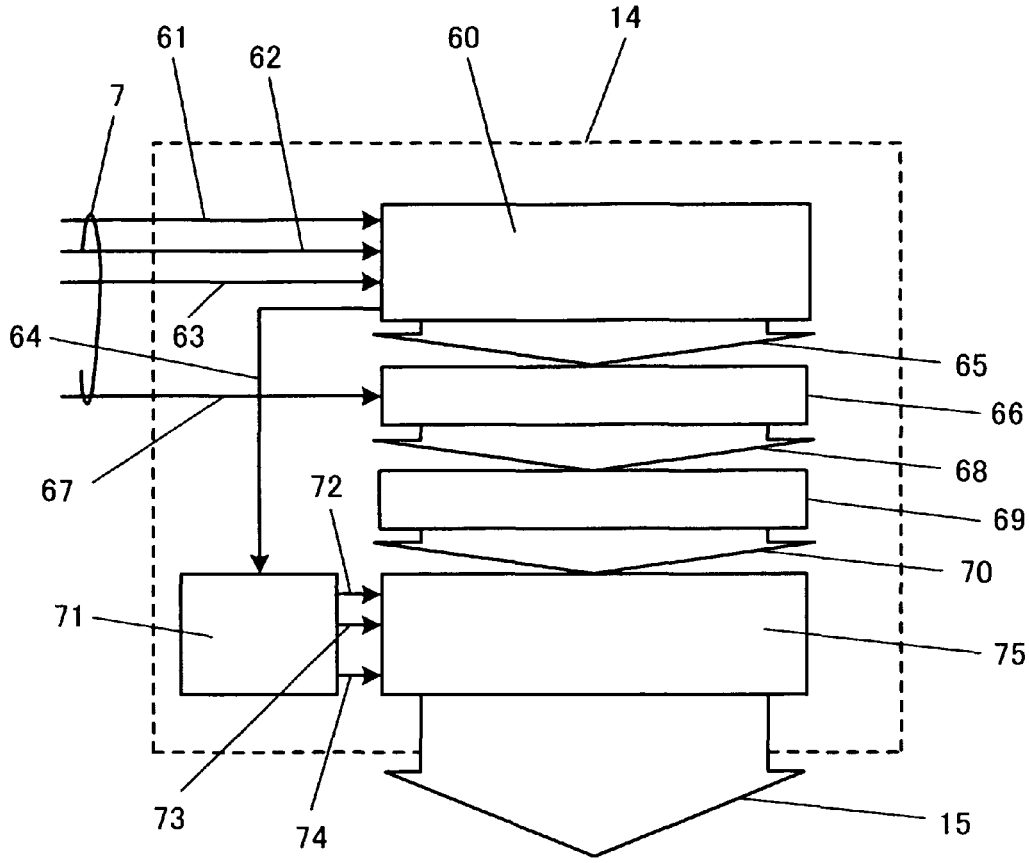
FIG. 7 is a block diagram illustrating an example of the internal configuration of the data line driving circuit 14 in FIG. 1.

FIG. 7 is a block diagram illustrating an example of the internal configuration of the data line driving circuit 14 in FIG. 1. In FIG. 7, the symbol 60 is a data shift circuit, 61 is a data starting signal, 62 is a data clock, 63 is display serial data, 64 is a horizontal retrace line period signal, and 65 is display shift data, and the data shift circuit 60 takes display serial data 63 for one line into one horizontal period using a data starting signal 61 as a reference for the start of take-in in accordance with the data clock 62 and outputs it as display shift data 65.

The symbol 66 is a one-line latch circuit, 67 is a horizontal latch clock and 68 is one-line latch data, and the one-line latch circuit 66 latches the display shift data 65 for one line and synchronizes it with the horizontal latch clock 67, and the results are outputted as one-line latch data 68, and at the same time, a horizontal retrace line period signal 64 indicating a period during which one-line latch data 68 is not outputted is outputted. The symbol 69 is a gradation voltage selecting circuit, and 70 is one-line display data. The gradation voltage selecting circuit 69 selects one level from among 64 levels of gradation voltage in accordance with one-line latch data, and outputs it as one-line display data 70.

The symbol 71 is a triangular wave generating circuit, 72 is a first triangular wave signal, 73 is a second triangular wave signal and 74 is a triangular wave switching signal, and the triangular wave generating circuit 71 generates a first triangular wave signal 72 of which one period is one frame period and a second triangular wave signal 73 having the same period and a different phase, and also generates a triangular wave switching signal 74 which indicates the timing with which the generated triangular wave is outputted to a data line. As described above, in the present embodiment, the phase of the triangular wave is opposite between odd columns and even columns, and therefore, the first triangular wave signal 72 is outputted to a data line in an odd column and the second triangular wave signal 73, of which the phase is opposite, is outputted to a data line in an even column in the following description. The symbol 75 is a gradation voltage-triangular wave switching circuit which outputs a data line driving signal 15 in accordance with the triangular wave switching signal 74 by switching the one-line display data 70 and the first triangular wave signal 72 in odd columns and the one-line display data 70 and the second triangular wave signal 73 in even columns.

Figure 8:
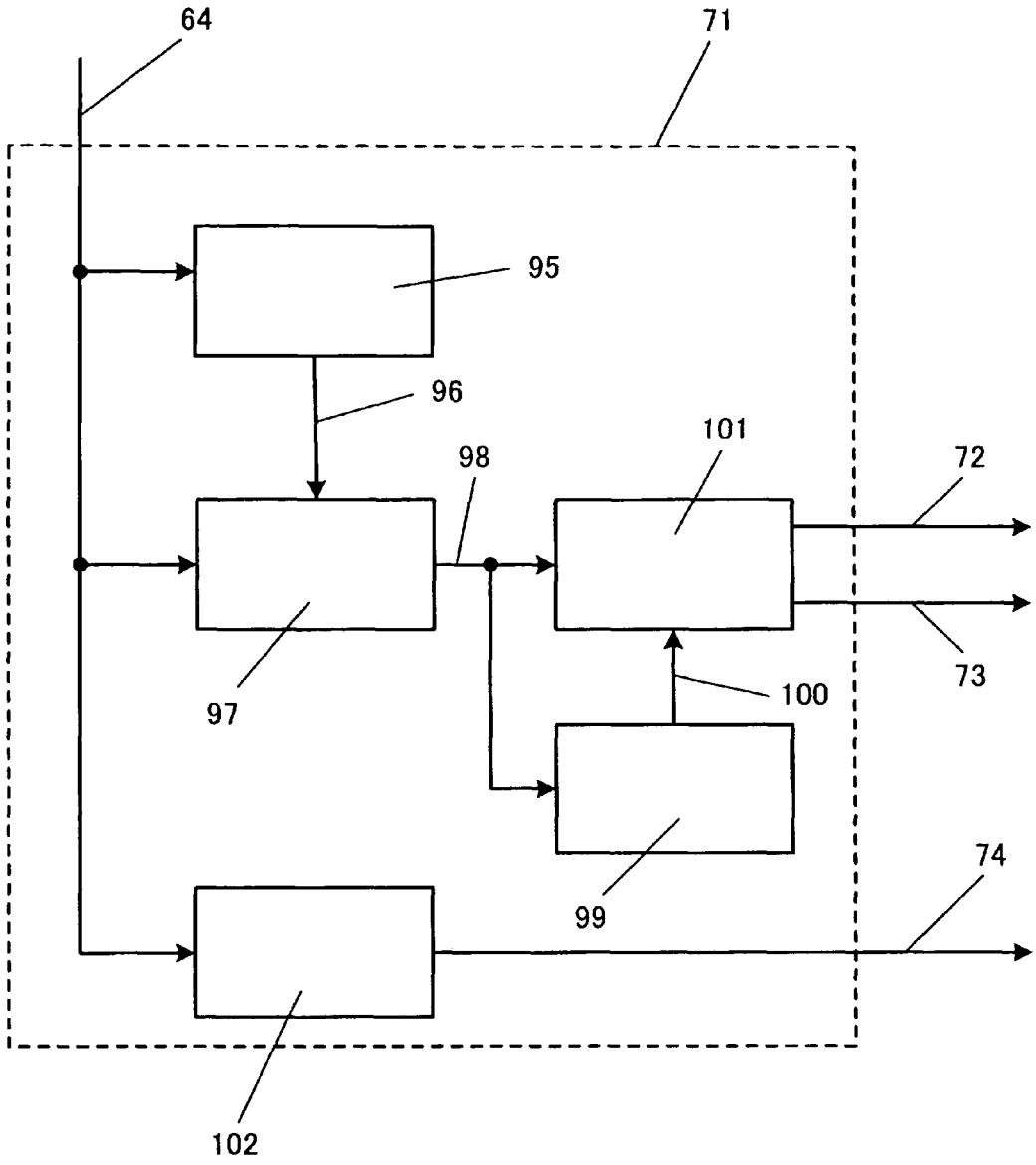
FIG. 8 is a block diagram illustrating an example of the internal configuration of the triangular wave generating circuit 71 in FIG. 7.

FIG. 8 is a block diagram illustrating an example of the internal configuration of the triangular wave generating circuit 71 in FIG. 7. In FIG. 8, the symbol 95 is a reference clock generating circuit, 96 is a reference clock, 97 is an up-down counting circuit, 98 is a first count output, 99 is a phase adjusting circuit, 100 is a second count output, 101 is a digital/analog converting circuit, and 102 is a triangular wave switching signal generating circuit. The reference clock generating circuit 95 generates a reference clock 96 for generating the first triangular wave signal 72 and the second triangular wave signal 73. The up-down counting circuit 97 is synchronized with the reference clock 96 so as to count down from the initial value to "0," and after that counts back up to the initial value, and then outputs the first count output 98. The phase adjusting circuit 99 shifts the phase of the first count output 98 arbitrarily and outputs the resulting signal as the second count output 100.

Here, in the present embodiment, the initial value is "63," which is the maximum value for 6-bit data, as with the display data. The first count output 98 and the second count output 100 are also 6-bit digital data, and in addition, the phase of the second triangular wave signal 73 is opposite to that of the first triangular wave signal 72, and the second count output 100 becomes the inverted output of the first count output 98 in the following description.

Figure 9:
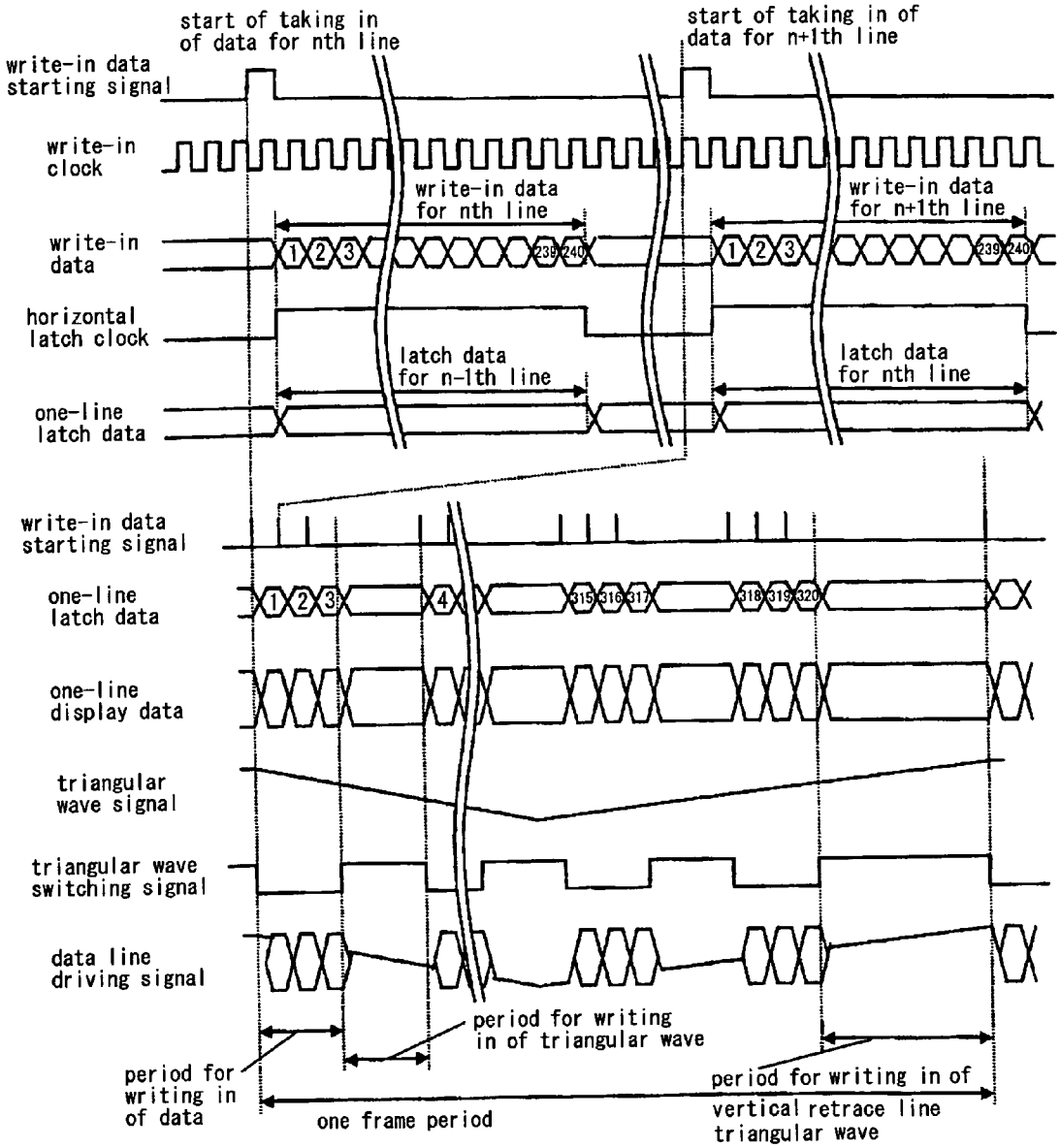
FIG. 9 is a diagram showing waveforms for the operation of the data line driving circuit 14 shown in FIG. 7.

FIG. 9 is a diagram illustrating waveforms for the operation of the data line driving circuit 14 shown in FIG. 7. The write-in data is taken in in accordance with the write-in clock using the timing with which the write-in data starting time becomes of a "high" state as a reference. For example, write-in data for the nth line starts being taken in at the rise of the write-in clock signal next to the timing with which data for the nth line starts being taken in. After all of the data for one line is taken in, one-line latch data starting from the rise to the drop in the horizontal latch clock signal is outputted.

For example, the write-in data for the nth line is outputted as latch data for the nth line at the rise in the horizontal latch clock signal wave of the next line after the completion of take-in of all of the data. FIG. 9 shows expanded time axes. The triangular wave switching signal becomes of the "high" state after one-line latch data is outputted for three lines, for example after one-line latch data is outputted for the first to third lines, and a triangular wave signal is outputted. Accordingly, the data line driving signal outputs one-line display data during the data write-in period, and a triangular wave signal is outputted during the period for the writing in of a triangular wave. In addition, in the present embodiment, the vertical retrace line period within one frame period is also a period for the writing in of a vertical retrace line triangular wave, during which a triangular wave signal is outputted.

Figure 10:
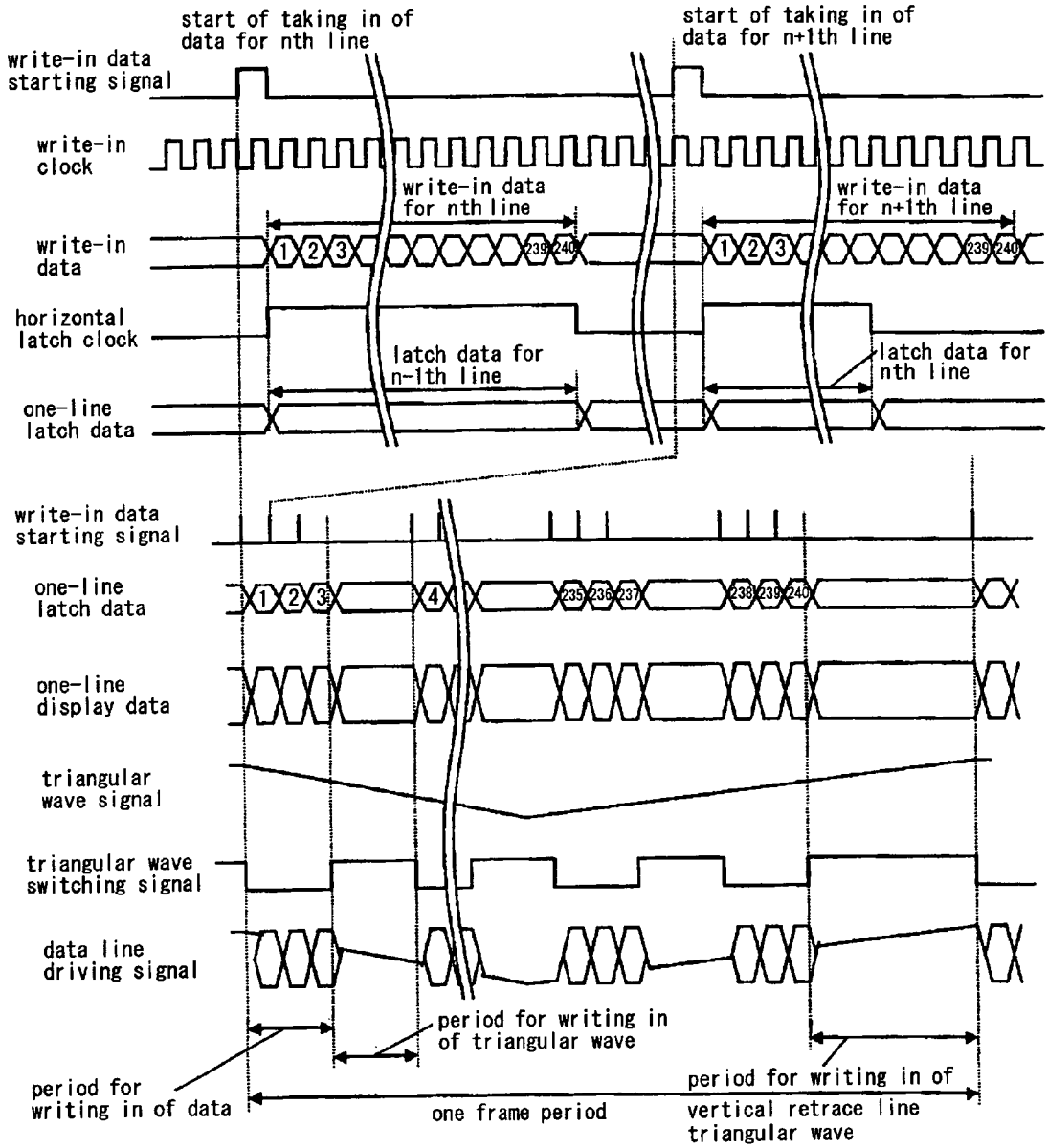
FIG. 10 is a diagram showing waveforms for the operation which makes the write-in period in the operation of driving the data line driving circuit 14 in FIG. 7 variable for each line.

FIG. 10 is a diagram illustrating waveforms for the operation for making the write-in period variable for each line during the operation for driving the data line of the line driving circuit 14 in FIG. 7. The width of one-line latch data is determined in accordance with the width of the horizontal latch clock signal, and in the case where the n-1th line is data write-in immediately after the light emission period and the nth line and the n-1th line are continuous write-in of display data, for example, the time required for rewrite is different, and thus, the width of the horizontal latch clock is adjusted. Here, write-in of data immediately after the light emission period requires more time than continuous write-in of display data, and a case where time control is carried out in accordance with the difference in the voltage for write-in (increase in difference in voltage→longer time, decrease in difference in voltage→shorter time) is given as one method for controlling the write-in period. The control of the write-in time is not limited to control using a horizontal latch clock signal, and control is also possible using the reset pulse width described in reference to FIG. 5. In addition, provision of control for triangular wave switching output is not limited to the inside the data line driving circuit, and it is also possible to provide control outside the data line driving circuit together with the switch.

Here, though a voltage which increases and decreases during a certain period is a triangular wave in the above description, it is also possible to use a nonlinear wave which gradually increases or gradually decreases along a displayed straight line instead of a triangular wave, so that change in the gradation can be accentuated or flattened out on the display.

The above described operation makes it possible to gain a highly bright image display by making the light emission time longer on self-luminous element displays where gradation control is carried out using horizontal retrace line light emission.

While we have shown and described several embodiments in accordance with our invention, it should be understood that disclosed embodiments are susceptible to change and modification without departing from the scope of the invention. Therefore, we do not intend to be bound by the details shown and described herein, but intend to cover all such changes and modifications within the ambit of the appended claims.

What is claimed is:

1. A driving method for an image display device that includes a display portion formed of a display region where a number of pixels are aligned in a matrix in rows and columns, a plurality of signal lines aligned so as to extend in the column direction of said matrix in order to input a display signal voltage into the pixels in said display region, and a signal line driving circuit for applying a signal voltage to said signal lines, the driving method comprising:

outputting, via said signal line driving circuit, a signal voltage in accordance with input display data for a number of signal lines arranged relative to one another in a direction of data lines within the display portion to said plurality of signal lines during a first portion of one-frame period; and outputting, via said signal line driving circuit, a voltage which increases or decreases for the number of signal lines collectively during a subsequent portion of the one-frame period for a certain period that correlates to a quantity of the number of signal lines to the plurality of signal lines, and wherein the voltage which increases or decreases during said certain period is a plurality of triangular waves that increase or decrease during the one frame period, the quantity of said number of signal lines is three or more, and the quantity of said number of signal lines is less than or equal to n/2, where n is a quantity of the pixels in the column direction.

2. An image display device, comprising:

a display portion where a number of pixels are aligned in a matrix in rows that extend in a direction in which data lines are aligned and columns that extend in a direction in which scanning lines are aligned;

a plurality of signal lines wired in the column direction in said matrix in order to input a display signal voltage to said pixels; and a signal line driving circuit for applying a signal voltage to said signal lines, said signal line driving circuit outputting a signal voltage in accordance with input display data for a number of pixels in a row to said plurality of signal lines during a first portion of one-frame period, and outputting a voltage which increases or decreases for the signal lines collectively during a subsequent portion of the one-frame period for a certain period that correlates to a quantity of the number of pixels to the plurality of signal lines, and wherein the voltage which increases or decreases during said certain period is a plurality of triangular waves that increase or decrease during the one frame period, a quantity of said plurality of signal lines is three or more, and the quantity of said plurality of signal lines is less than or equal to n/2, where n is a quantity of the pixels in the column direction.

3. An image display device, comprising:

a display portion where a number of pixels are aligned in a matrix in rows that extend in a direction in which data lines are aligned and columns that extend in a direction in which scanning lines are aligned;

a plurality of signal lines for inputting a display signal to said pixels; and a signal line driving circuit for outputting said display signal to said signal lines in accordance with display data, characterized in that said display portion performs a first write in operation of said display signal into said pixels for a first set of N lines, where N is an integer of three or higher and less than or equal to n/2, and n is a quantity of the pixels that are in each of the columns, and subsequently performs a second write in operation of a triangular wave signal which increases or decreases during one frame period into the pixels for said first set of N lines collectively, and sequentially repeats said first write in operation and said second write in operations for controlling light emission of the pixels for each subsequent set of N lines for a number of pixels every N lines in said display portion, and wherein a phase of said triangular wave signal is different for adjacent pixel columns.

* * * * *